United States Patent [19]

Fleissner

[11] 4,051,604

[45] Oct. 4, 1977

[54] COUPLING FOR THE SUPPLY AND DISCHARGE OF HEATING MEDIUM, FOR EXAMPLE IN TENTERING UNITS

[75] Inventor: Hans Fleissner, Frankfurt am Main, Germany

[73] Assignee: Vepa AG, Switzerland

[21] Appl. No.: 592,767

[22] Filed: July 2, 1975

[30] Foreign Application Priority Data

July 2, 1974 Germany ..... 2431806

[51] Int. Cl.[2] ..... F26B 11/02

[52] U.S. Cl. ..... 34/124; 165/90; 285/134

[58] Field of Search ..... 34/124, 125, 119, 120; 165/89, 90; 285/134, 135

[56] References Cited

U.S. PATENT DOCUMENTS

| | | | |
|---|---|---|---|
| 2,643,099 | 6/1953 | Kinraide et al. | 34/124 |
| 3,034,224 | 5/1962 | Wood | 34/124 |
| 3,606,394 | 9/1971 | Maurer et al. | 285/134 |

FOREIGN PATENT DOCUMENTS

| | | | |
|---|---|---|---|
| 138,799 | 9/1950 | Australia | 34/124 |
| 619,602 | 9/1935 | Germany | 34/124 |

*Primary Examiner*—Kenneth W. Sprague
*Assistant Examiner*—James C. Yeung
*Attorney, Agent, or Firm*—Craig & Antonelli

[57] ABSTRACT

A coupling device for the supply and discharge of a heating medium in combination with a godet having a twin roll jacket and guide means provided within the jacket for directing the flow of a heating medium necessary for heating the godet. The device has a hollow shaft arrangement secured to the godet, and the shaft arrangement includes an outer pipe spaced from an inner pipe to define an annular space therebetween for supplying the heating medium to the godet and a passage for removing the heating medium from the godet. The outer pipe and the inner pipe each are permanently connected at one end to the godet for rotation therewith and a rotary pressure cap is disposed at a free end of said hollow shaft arrangement.The rotary pressure cap has means for engaging the other ends of the pipes so that the pipes are allowed to rotate within the rotary pressure cap and the engaging means also allows the outer pipe to expand longitudinally due to temperature fluctuation and to cause movement of the rotary pressure cap relative to the godet.

15 Claims, 1 Drawing Figure

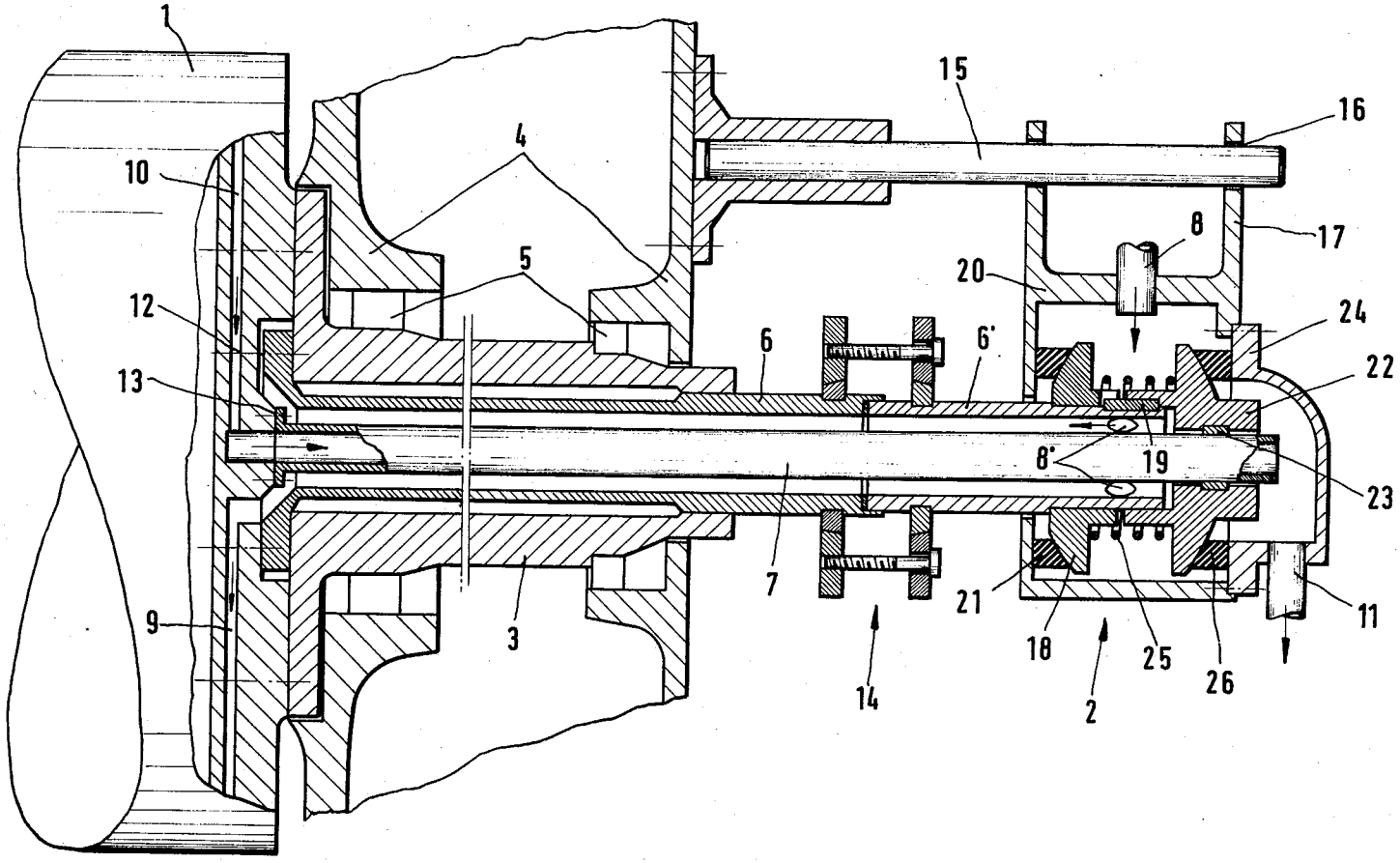
16
17
24
22
23
11
26
8
19
25
2
8'
18
15
20
6'
21
14
6
7
4
5
3
1
10
12
13
9

COUPLING FOR THE SUPPLY AND DISCHARGE OF HEATING MEDIUM, FOR EXAMPLE IN TENTERING UNITS

This invention relates to a coupling device for the supply and discharge of heating medium is tentering machines or cylinder dryers utilized especially for synthetic fibers, with a twin roll jacket provided especially at each godet, and a positive guide means provided therein for a heating medium necessary for heating the godet, this medium flowing into a free annular space between the two cylindrical jackets and being fed and discharged, respectively, in the hollow bearing shaft of each godet by means of two pipes surrounding each other, for example, at a distance.

In the conventional godets, mounting in an overhung manner, for the heat treatment and optionally simultaneous drawing of synthetic fibers, it is customary to feed the heating medium, generally superheated steam, to the godet through the bearing shaft of the latter. For this purpose, the bearing shaft must be of a hollow construction and must receive at least one pipe arranged at a spacing from the wall of the bearing shaft. The heating medium would then be fed, for example, through the pipe, and the condensate would flow off through the annular space encompassed by the pipe. The throughflow direction can, however, also be reversed. A great problem presenting itself in such constructions is the heat loss in the bearing box, i.e. the transfer of heat to the bearing shaft. The bearing shaft of the godet is strongly heated by the heating medium fed thereto, and gives off this heat, which additionally effects a change in the length of the shaft, to the bearing box. This heat loss can be partially avoided by disposing within the hollow bearing shaft not only a single pipe, but rather two pipes, wherein the outer pipe should additionally be located at a spacing from the inner wall of the bearing shaft. In this way, a larger heat loss can be avoided due to the lack of contact between the heating medium supply and discharge pipes and the walls of the bearing shaft.

It is customary to introduce the heating medium into the bearing shaft at the free ends of the pipes beyond the godet bearing. For this purpose, a so-called rotary pressure cap is provided having an opening for the feeding of the heating medium and an opening for the discharge of the condensate backflow. This rotary pressure cap must be disposed to be stationary due to the necessary feed and supply lines engaging from the outside. However, since the pipes must somewhere be joined to the rotating godet, bearing sites are produced with relative motion which, on the one hand, are subject to wear and tear and, on the other hand, can be steam leakage points. Therefore, these bearing sites always give rise to great annoyance, since it is impossible to obtain a lasting, exact seal due to the occurring thermal expansions, bending stresses, and wear phenomena.

It is known from DOS (German Unexamined Laid-Open Application) 2,104,392 to connect the external pipe with the godet for rotation therewith. However, the inner pipe for feeding the heating medium is supported in a bearing bushing to be rotatable with respect to the godet, so that thus a relative speed exists between the stationary internal pipe and the bearing shaft. At this bearing site, the above-discussed problems have always occurred.

The invention is based on the problem of providing a coupling device for the supply and discharge of heating medium wherein the feeding and discharging of the heating medium can be conducted without problems over the useful life of the machine in spite of the unavoidable thermal expansions on the pipes and bearing sites of these pipes and in spite of the unavoidable wear phenomena. The construction is to be such that the natural wear and tear can be ignored. If, after all, the coupling device is in need of repair when a rather long service time of the machine has elapsed, the places where such wear has occurred are to be rapidly accessible, and any repair work is to be carried out within a short period of time.

Starting with the coupling device disclosed hereinabove, the invention first of all provides, for solving the posed problem, to connect the heat medium supply pipe as well as discharge pipe with the godet for rotation therewith. If the pipes are joined fixedly to the godet at the junction point between the bearing shaft and the godet, then no wear occurs any longer at this poorly accessible location at the end face of the godet. Consequently, it will never be necessary any more to effect any repair work at that point. Heretofore, this solution has never been contemplated, because a rotating outer and inner pipe will cause problems for the rotary pressure cap and also because it is more difficult to discharge the condensate by means of such a rotating pipe.

It is therefore necessary to adapt the construction of the heretofore customary rotary pressure cap to the posed conditions. However, in this connection, no bearing sites may be present at the rotary pressure cap which would cause leakage due to wear and tear; in particular, no relative motions must occur at locations where bending phenomena of the shaft are observed. Thus, it has heretofore always been noticed, for example, that after a certain operating time of a godet, the rotary pressure cap executes oscillations produced by the fact that the bearing shaft no longer rotates in an exactly centered manner. Such oscillations, of course, increase the wear and tear on the rotary pressure cap.

In a further development of basic idea, the present invention proposes to solve these problems by providing that exclusively fixed parts of parts rotating with the pipes are brought into engagement with these pipes. In other words, no bearing sites of all with relative motion are to be produced at the pipes proper. Rather, it is advantageous if the parts fixedly engaging the pipes are fashioned as step bearings which, in turn, rotate exclusively with respect to stationary housing walls on the rotary pressure cap disposed at the free ends of the pipes beyond the godet bearing. Suitable for this purpose are especially step bearings arranged at right angles to the extension of the pipes and encompassing these pipes. In such a case, radial carbon bearings are disposed between the housing walls and the step bearings, which latter are of a maximally spherical structure, so that even in case the rotary pressure caps are no longer arranged completely centered it is possible to avoid leakages.

It is known to attach the rotary pressure cap merely at the ends of the pipes. This flying mounting is necessary, because the pipes expand, for example, when the apparatus is set in operation and thus the spacing between the rotary pressure cap and the bearing box is increased. However, by means of such a flying mounting, a durable dimensional accuracy cannot be attained. In an advantage embodiment, the present invention provides that the rotary pressure cap rotates with the device, and in this connection it is advantageous to attach the rotary pressure cap additionally to the bearing box of the godet, for example by extending a supporting rod from the bearing box and pushing this rod through bores in the housing of the rotary pressure cap. Due to changes in the length of the pipes, the rotary pressure cap must now be held to be axially displaceable along the supporting rod. On account of this construction, the weight of the rotary pressure cap and also other weight changes occurring during the operation of the system have no influence on the stability of the pipes. In other words, the pipes will always extend exactly centrally, so that also the rotary pressure cap is always held in a centered position and executes no eccentric vibrations.

In a further development of the coupling mechanism according to this invention, steps are taken to consider the thermal expansions occurring at the pipes during the operation of the system so that such expansions can occur without affecting the bearings at the rotary pressure cap. As mentioned, it is known to attach a step bearing at the outer pipe for rotation therewith, which bearing is sealed with respect to the wall of the rotary pressure cap. The invention now provides in addition to this step bearing for the outer pipe a further step bearing for the inner pipe. Preferably, this step bearing for the inner pipe is to engage the outer pipe and is also to be preferably connected to rotation with respect to the outer pipe and thus also the inner pipe. As a consequence, there are no relative motions between the step bearing for the inner pipe and the inner pipe although there is no connection between the inner pipe and the step bearing for rotating together. Rather, the step bearing for sealing the inner pipe is centered on the outer pipe, and the inner pipe is held in the step bearing by way of a bushing. In this bushing, the inner pipe can be axially displaced so that also the centrally rotating inner pipe can execute axial movements without affecting the seals.

The individual features of this invention show how important each single detail of the construction is for solving the total problem. The individual ideas are of significance for the total construction each on its own, but in the final analysis also in combination with one another.

The drawing illustrates an embodiment of the device of this invention. With reference to the drawing, additional inventive features will be described below, in addition to those recited above.

The drawing shows a godet 1 in an elevational view, and its bearing with a rotary pressure cap 2 in a sectional illustration. The godet is supported by way of a bearing shaft 3 in the bearing box 4 via customary ball bearings 5. The godet 1 has a dual roll jacket, not shown, with positive guide means provided therein for the heating medium necessary to heat the godet, this medium flowing into the free annular space produced by the twin roll jacket. In the embodiment as shown, the heating medium passes via a supply line 8 into the rotary pressure cap 2 and via bores 8' into the outer pipe 6'. From there, the heating medium, such as superheated steam, flows through the annular duct between the outer pipe 6, 6' and the inner pipe 7 in the hollow bearing shaft 3. In the base within the rear end face of the godet, the heating medium then flows into an annular space from where bores 9 conduct the heating medium into the free annular space between the two cylindrical jackets. After the heating medium has passed at least twice over the operating width of the godet, it enters the zone of the bores 10 which are connected to the inner pipe 7 also as the base of the godet. The presently condensed steam is conducted through the inner pipe 7 to the rotary pressure cap 2 and from there flows without pressure to the outside by means of a heating medium discharge line 11.

The outer pipe 6 as well as the inner pipe 7 are connected by means of screws 12 or 13 to the end face of the godet for rotation therewith. Thus, no bearing sites with relative motions are produced in the zone of this end face which is not accessible from the outside. Such bearing sites are rather located exclusively in the rotary pressure cap 2 which latter is connected by way of a clamping coupling 14 with the outer pipe 6 so that it can be readily detached.

The rotary pressure cap is not attached at the ends of the pipe 6', 7 by a flying (overhung) mounting, but rather is held by the bearing box 4 means of a supporting rod 15. This supporting rod 15 extends freely from the bearing box and passes through bores 16 in the housing 17 of the rotary pressure cap 2. The bores are dimensioned so that an axial displacement of the rotary pressure cap along this supporting rod 15 is made possible.

A thrust ring or bearing ring 18 is mounted by means of a wedge 19 to the outer pipe 6' for rotation therewith. The surface of the thrust ring 18 facing the housing wall 20 of the rotary pressure cap 2 is fashioned to be spherical or crowned to be able to compensate without leakage losses for small inaccuracies based on the central bearing during the course of the operating time of the total apparatus. Between this spherical surface of the thrust ring and the housing wall 20, a radial carbon bearing 21 is disposed, thus affording a sufficient, service-free seal.

In the same way, a further thrust ring 22 for the inner pipe 7 is attached oppositely to the step bearing 18 at the outer pipe 6' for rotation therewith by means of the wedge 19; this thrust ring 22 is centered on the outer pipe 6' by extending therearound with a flange 23. To provide a seal with respect to the inner pipe 7, the thrust ring 22 contacts the inner pipe 7, for example with a stuffing gland 23, thus centering this pipe. This construction makes it possible to compensate for axial changes in length of the inner pipe 7 without affecting the seal. At the same time, there are no relative motions between the inner pipe 7, which extends entirely through the hollow bearing shaft 3 and entirely through the outer pipe 6' and the thrust ring 22 proper. This is so because the thrust ring is joined to the outer pipe 6', 6 and the latter is likewise joined to the godet. Just as the thrust ring 18, the thrust ring 22 is likewise of a spherical or crowned design on the surface facing the housing wall 24 and exerts its sealing action due to a spring force from the annular spring 25 via a radial carbon bearing 26 with respect to the lid-shaped wall 24 of the rotary pressure cap 2.

By means of this construction, changes in length occurring due to temperature fluctuations can be compensated for without affecting the structure of the rotary pressure cap. The rotary pressure cap 2 will move along the supporting rod 15 on account of a change in length of the outer pipe 6, 6'. However, this does not influence the radial carbon bearings 21, 26. The inner pipe 7, discharging the condensate, can axially shift in the stuffing gland 23 and is preferably extended past the outer end face of the thrust ring 22, to terminate exactly above the outlet pipe 11, which is fashioned with a larger diameter. In this way, a damming up of the liquid condensate is avoided and a rapid discharge is ensured.

What is claimed is:

1. A coupling device for the supply and discharge of a heating medium in combination with a godet having a twin roll jacket and guide means provided within said jacket for directing the flow of a heating medium necessary for heating the godet, said device comprising a hollow shaft arrangement secured to said godet, said shaft arrangement including an outer pipe spaced from an inner pipe to define an annular space therebetween for supplying the heating medium to the godet and a passage for removing the heating medium from the godet, the outer pipe and the inner pipe each being permanently connected to one end of the godet for rotation therewith and a rotary pressure cap disposed at a free end of said hollow shaft arrangement, said rotary pressure cap including means for engaging the other ends of said pipes whereby said pipes are allowed to rotate within said rotary pressure cap, said engaging means also allowing the outer pipe to expand longitudinally due to temperature fluctuation and to cause movement of the rotary pressure cap relative to said godet.

2. A device according to claim 1, wherein said engaging means also includes means for allowing the inner pipe to expand longitudinally due to temperature fluctuation without relative movement to said rotary pressure cap.

3. A device according to claim 1, wherein said means for engaging said pipes includes means that are fixed to and that rotate with said pipes.

4. A device according to claim 3, wherein said means fixedly engaging the pipes comprise step bearings which, in turn, rotate exclusively with respect to stationary housing walls of said rotary pressure cap, said cap being disposed at the free ends of said pipes beyond a bearing box for supporting said godet.

5. A device according to claim 4, wherein the housing walls of the rotary pressure cap are mounted in a fixed position.

6. A device according to claim 5, wherein the rotary pressure cap connected to the ends of said pipes is additionally supported on said bearing box.

7. A device according to claim 6, wherein a supporting rod extends from the bearing box, said rod being passed through bores in the housing walls of the rotary pressure cap.

8. A device according to claim 7, wherein the rotary pressure cap is held on the supporting rod so that said cap is axially displaceable.

9. A device according to claim 4, wherein a first step bearing is connected to the outer pipe for rotation therewith, said first bearing being sealed with respect to a wall of the rotary pressure cap, and in addition to said first bearing provided for sealing the outer pipe there is also provided a second step bearing for the inner pipe.

10. A device according to claim 9, wherein the second step bearing provided for the inner pipe also engages the outer pipe.

11. A device according to claim 10, wherein the second step bearing for effecting a sealing action with respect to the inner pipe is arranged centrally with respect to the outer pipe and is likewise connected for rotation with respect to the outer pipe and also the inner pipe.

12. A device according to claim 11, wherein the second step bearing for sealing the inner pipe is centered on the outer pipe and the inner pipe is centered in the second pipe bearing by way of bushing.

13. A device according to claim 12, wherein the inner pipe is held axially displaceably within said bushing.

14. A device according to claim 9, wherein the two step bearings are pressed by the force of a spring against radial carbon bearings and thus against the stationary housing walls of the rotary pressure cap.

15. A device according to claim 14, wherein the inner pipe penetrates the second step bearing end terminates above a condensate discharge nipple connected to the rotary pressure cap housing.

* * * * *